US010258165B2

(12) United States Patent
Horst et al.

(10) Patent No.: US 10,258,165 B2
(45) Date of Patent: Apr. 16, 2019

(54) INFANT SUPPORT SEAT

(71) Applicant: Wonderland Switzerland AG, Steinhausen (CH)

(72) Inventors: Aj Horst, West Lawn, PA (US); Curtis M Hartenstine, Birdsboro, PA (US); Ryan Miller, Lancaster, PA (US)

(73) Assignee: Wonderland Switzerland AG, Steinhausen (CH)

( * ) Notice: Subject to any disclaimer, the term of this patent is extended or adjusted under 35 U.S.C. 154(b) by 14 days.

(21) Appl. No.: 15/649,650

(22) Filed: Jul. 14, 2017

(65) Prior Publication Data

US 2018/0014658 A1 Jan. 18, 2018

Related U.S. Application Data

(60) Provisional application No. 62/362,286, filed on Jul. 14, 2016.

(51) Int. Cl.

| | |
|---|---|
| ***A47D 11/00*** | (2006.01) |
| ***A47D 9/00*** | (2006.01) |
| ***A47D 1/00*** | (2006.01) |
| ***A47D 1/10*** | (2006.01) |

(52) U.S. Cl.
CPC ..... *A47D 1/002* (2013.01); *A47D 1/10* (2013.01)

(58) Field of Classification Search
CPC ..... B60N 2/2821
See application file for complete search history.

(56) References Cited

U.S. PATENT DOCUMENTS

| | | | | |
|---|---|---|---|---|
| 3,142,512 | A | 7/1964 | Hamilton | |
| 4,998,307 | A * | 3/1991 | Cone | B60N 2/2806 297/183.2 |
| 5,769,727 | A | 6/1998 | Fair | |
| 9,661,936 | B2 * | 5/2017 | Lin | A47D 1/002 |
| 2003/0177574 | A1 * | 9/2003 | Waldman | A47D 7/007 5/93.1 |
| 2005/0005353 | A1 * | 1/2005 | Waldman | A47D 9/00 5/101 |
| 2005/0253432 | A1 * | 11/2005 | Flanagan | A47D 13/10 297/274 |

(Continued)

FOREIGN PATENT DOCUMENTS

| | | |
|---|---|---|
| DE | 20 2012 100 907 U1 | 5/2012 |
| DE | 10 2017 211 550 A1 | 1/2018 |

*Primary Examiner* — Shin H Kim
(74) *Attorney, Agent, or Firm* — Winston Hsu

(57) ABSTRACT

An infant support seat includes an upper structure, a lower frame structure, and a seat structure. The lower frame structure is connected to the upper frame structure to define a containing space with the upper frame structure and be located under the containing space. The seat structure is disposed in the containing space. The seat structure includes a seat back and a seat bottom. The seat back is rotatable relative to the lower frame structure for rotating between a lying position and a sitting position. The seat bottom is pivotally joined to the seat back. The seat bottom is rotatable relative to the lower frame structure to form a lying surface cooperatively with the seat back when the seat back rotates to the lying position and rotate to be tilted upward relative to the lower frame structure when the seat back rotates to the sitting position.

10 Claims, 12 Drawing Sheets

(56) References Cited

U.S. PATENT DOCUMENTS

| | | | | |
|---|---|---|---|---|
| 2010/0229301 | A1* | 9/2010 | Arnold, IV | A47D 7/04 5/93.2 |
| 2012/0235450 | A1 | 9/2012 | Oren | |
| 2012/0266380 | A1* | 10/2012 | Conrad | A47D 7/04 5/93.1 |
| 2013/0193723 | A1 | 8/2013 | Wuerstl | |
| 2013/0326808 | A1* | 12/2013 | Saint | A47D 5/00 5/93.1 |
| 2015/0082539 | A1 | 3/2015 | Lin | |
| 2015/0342367 | A1* | 12/2015 | Corso | A47D 9/02 5/102 |
| 2016/0058201 | A1* | 3/2016 | Pavkov | A47D 13/107 297/440.22 |
| 2016/0192787 | A1* | 7/2016 | Perrin | A47D 1/006 297/16.1 |
| 2017/0196373 | A1* | 7/2017 | Sclare | A47D 11/007 |

* cited by examiner

INFANT SUPPORT SEAT

CROSS REFERENCE TO RELATED APPLICATIONS

This application claims the benefit of U.S. Provisional Application No. 62/362,286, which was filed on Jul. 14, 2016, and is incorporated herein by reference.

BACKGROUND OF THE INVENTION

1. Field of the Invention

The present invention relative to an infant support seat, and more specifically, to an infant support seat with an adjustable seat back.

2. Description of the Prior Art

In general, an infant support seat is mounted on a support frame (e.g. a play yard) for a caregiver to take care of an infant. However, since the infant support seat usually serves a singular purpose as a changer, a napper, or a bassinet, it limits convenience of the infant support seat in use.

SUMMARY OF THE INVENTION

The present invention provides an infant support seat. The infant support includes an upper frame structure, a lower frame structure, and a seat structure. The lower frame structure is connected to the upper frame structure to define a containing space with the upper frame structure and be located under the containing space. The seat structure is disposed in the containing space. The seat structure includes a seat back and a seat bottom. The seat back is rotatable relative to the lower frame structure for rotating between a lying position and a sitting position. The seat bottom is pivotally joined to the seat back. The seat bottom is rotatable relative to the lower frame structure to form a lying surface cooperatively with the seat back when the seat back rotates to the lying position. The seat bottom rotates to be tilted upward relative to the lower frame structure when the seat back rotates to the sitting position.

The present invention further provides an infant support seat. The infant support seat includes an upper frame structure, a lower structure, and a seat structure. The lower frame structure is connected to the upper frame structure to define a containing space with the upper frame structure and be located under the containing space. The seat structure is disposed in the containing space. The seat structure includes a seat back, a seat bottom, and two side panels. The seat back is pivoted to the lower frame structure for rotating between a lying position and a sitting position. The seat bottom has a bridge portion and a bottom portion. The bridge portion is pivoted to the bottom portion and the seat back respectively. The bottom portion is pivoted to the lower frame structure. The two side panels are located at two sides of the bridge portion respectively. A first side of each side panel is slidably pivoted to the bridge portion. A second side of each side panel is slidably connected to the seat back and the bottom portion. The first side is opposite to the second side. When the seat back rotates from the lying position to the sitting position, the first side of each side panel slides along the bridge portion and the second side of each side panel slides on the seat back and the bottom portion respectively with rotation of the seat back to make each side panel pivots upwardly and inwardly relative to the bridge portion, so as to guide the bottom portion to rotate together with the seat back to be tilted upward relative to the lower frame structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
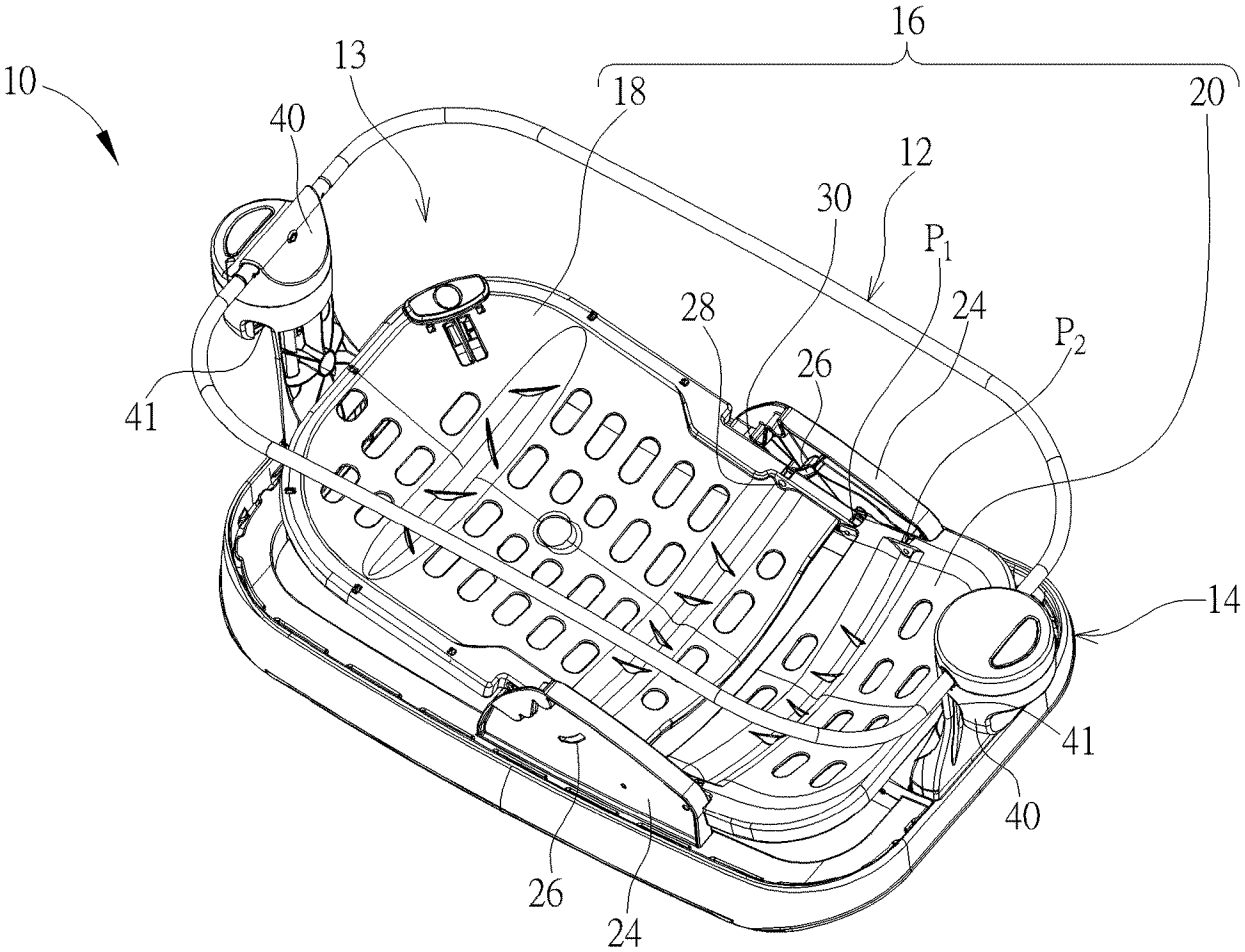
FIG. 1 is a diagram of an infant support seat according to an embodiment of the present invention.

Please refer to FIG. 1, which is a diagram of an infant support seat 10 according to an embodiment of the present invention. As shown in FIG. 1, the infant support seat 10 includes an upper frame structure 12, a lower frame structure 14, and a seat structure 16. The lower frame structure 14 is connected to the upper frame structure 12 to define a containing space 13 with the upper frame structure 12 and be located under the containing space 13. The seat structure 16 is disposed in the containing space 13 for allowing a caregiver to place an infant thereon.

Figure 2:
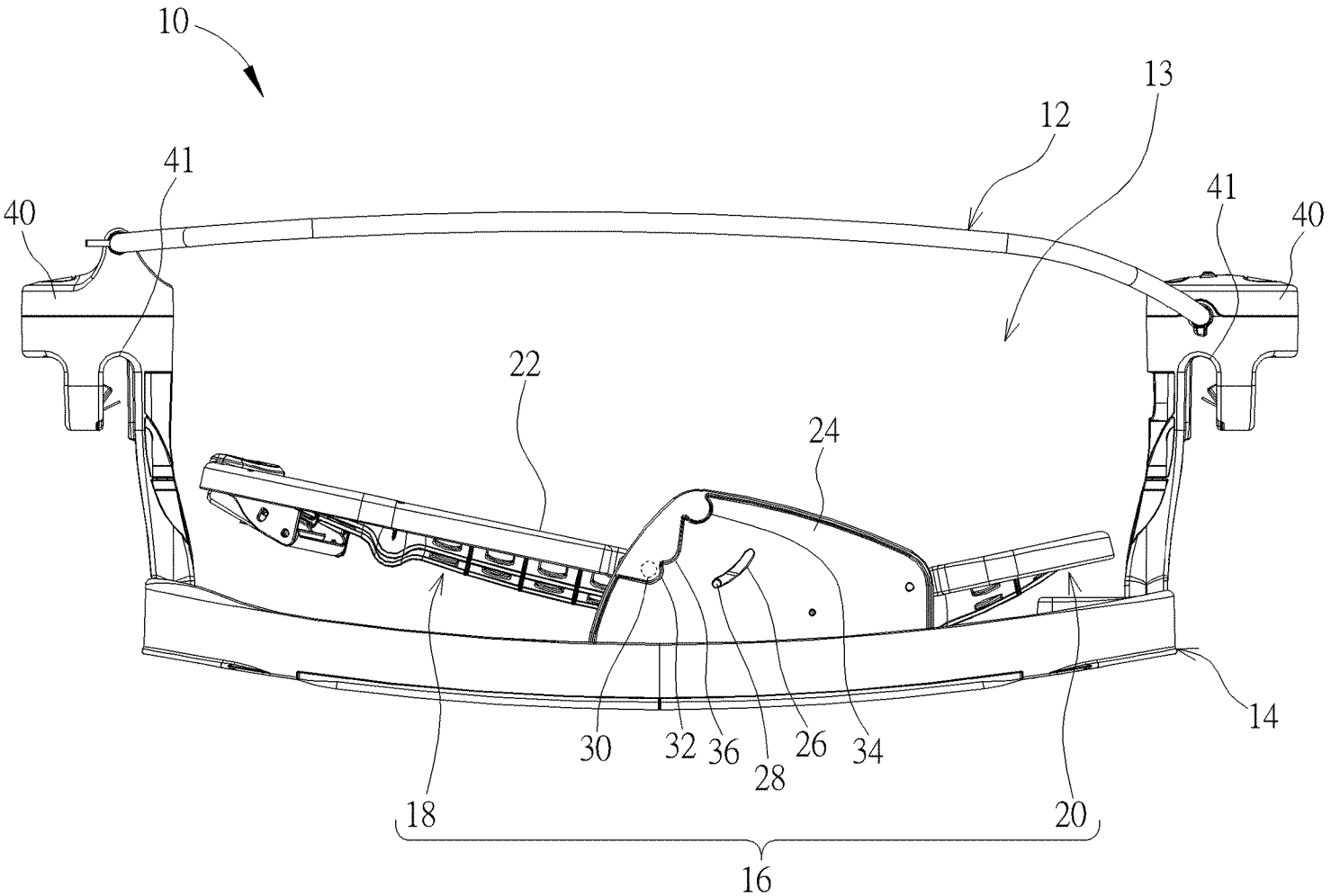
FIG. 2 is a side view of the infant support seat in FIG. 1.
Figure 3:
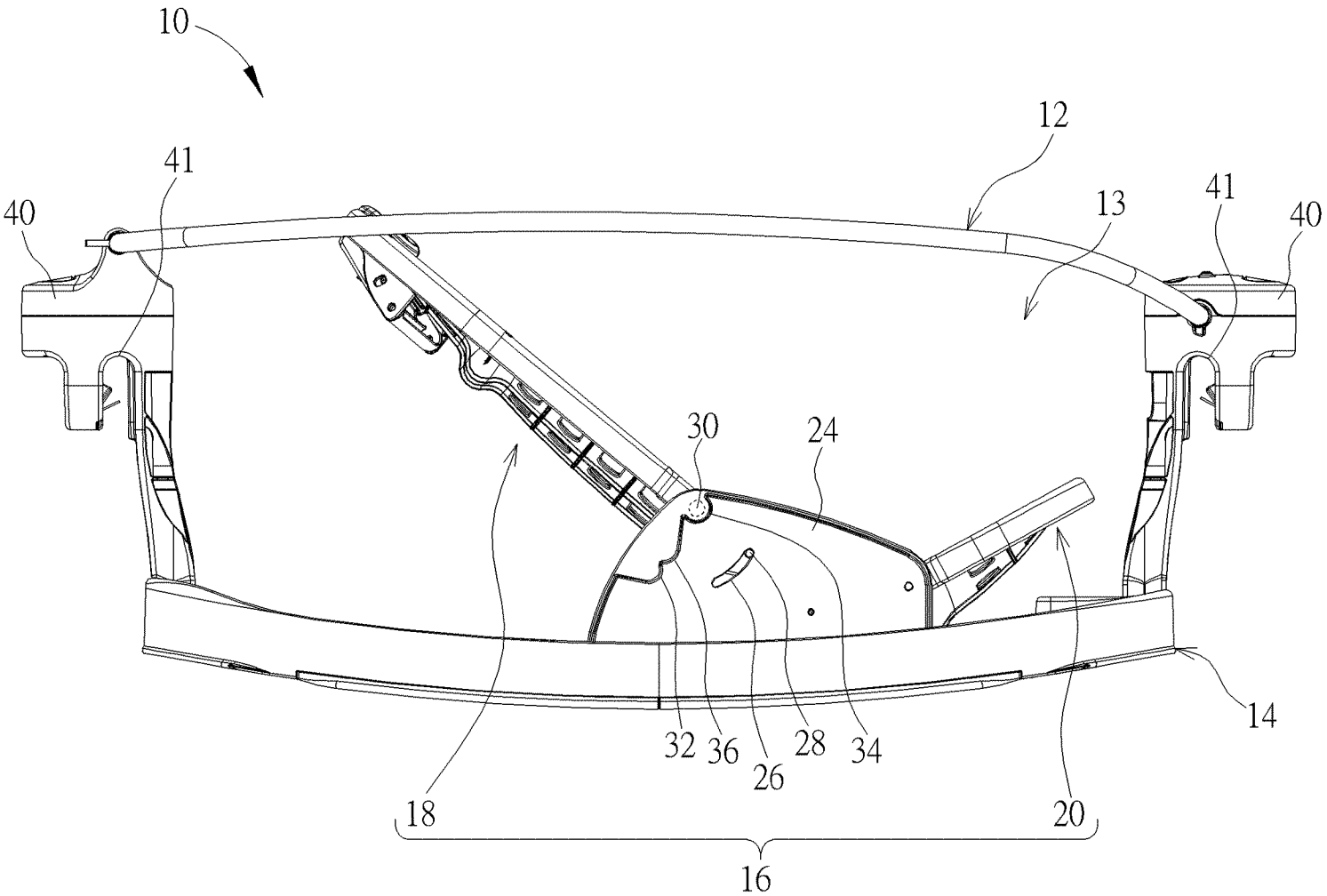
FIG. 3 is a side view of a seat back in FIG. 2 rotating to a sitting position.

More detailed description for the infant support seat 10 is provided as follows. Please refer to FIG. 1, FIG. 2, and FIG. 3. FIG. 2 is a side view of the infant support seat 10 in FIG. 1. FIG. 3 is a side view of a seat back 18 in FIG. 2 rotating to a sitting position. As shown in FIG. 1, FIG. 2, and FIG. 3, the seat structure 16 includes a seat back 18 and a seat bottom 20. The seat back 18 is rotatable relative to the lower frame structure 14 for rotating between a lying position as shown in FIG. 2 and the sitting position as shown in FIG. 3. The seat bottom 20 is pivotally joined to the seat back 18 and rotatable relative to the lower frame structure 14. Accordingly, the seat bottom 20 could form a lying surface 22 cooperatively with the seat back 18 when the seat back 18 rotates to the lying position as shown in FIG. 2, and the seat bottom 20 could rotate to be tilted upward relative to the lower frame structure 14 when the seat back 18 rotates to the sitting position as shown in FIG. 3.

To be more specific, at least one side of the lower frame structure 14 has an upright plate 24 extending therefrom (two upright plates 24 extend from the two sides of the lower frame structure 14 respectively as shown in FIG. 1, but not limited thereto, meaning that the present invention could adopt the design that there is only one upright plate 24 formed on one side of the lower frame structure 14). A guide detail 26 (e.g. an arc-shaped slot) is formed on the upright plate 24. The seat back 18 has a guide pin 28 slidably disposed through the guide detail 26. The seat bottom 20 is pivotally connected to the upright plate 24. In this embodiment, a pivotal position $P_1$ of the seat back 18 and the seat bottom 20 could preferably be located between the guide pin 28 and a pivotal position $P_2$ of the seat bottom 20 and the upright plate 24 as shown in FIG. 1. Accordingly, during rotation of the seat back 18, the guide pin 28 slides along the guide detail 26 to guide the seat back 18 to rotate between the lying position as shown in FIG. 2 and the sitting position as shown in FIG. 3, and the seat bottom 20 rotates together with the seat back 18 via pivotal connection between the seat back 18 and the seat bottom 20.

Figure 4:
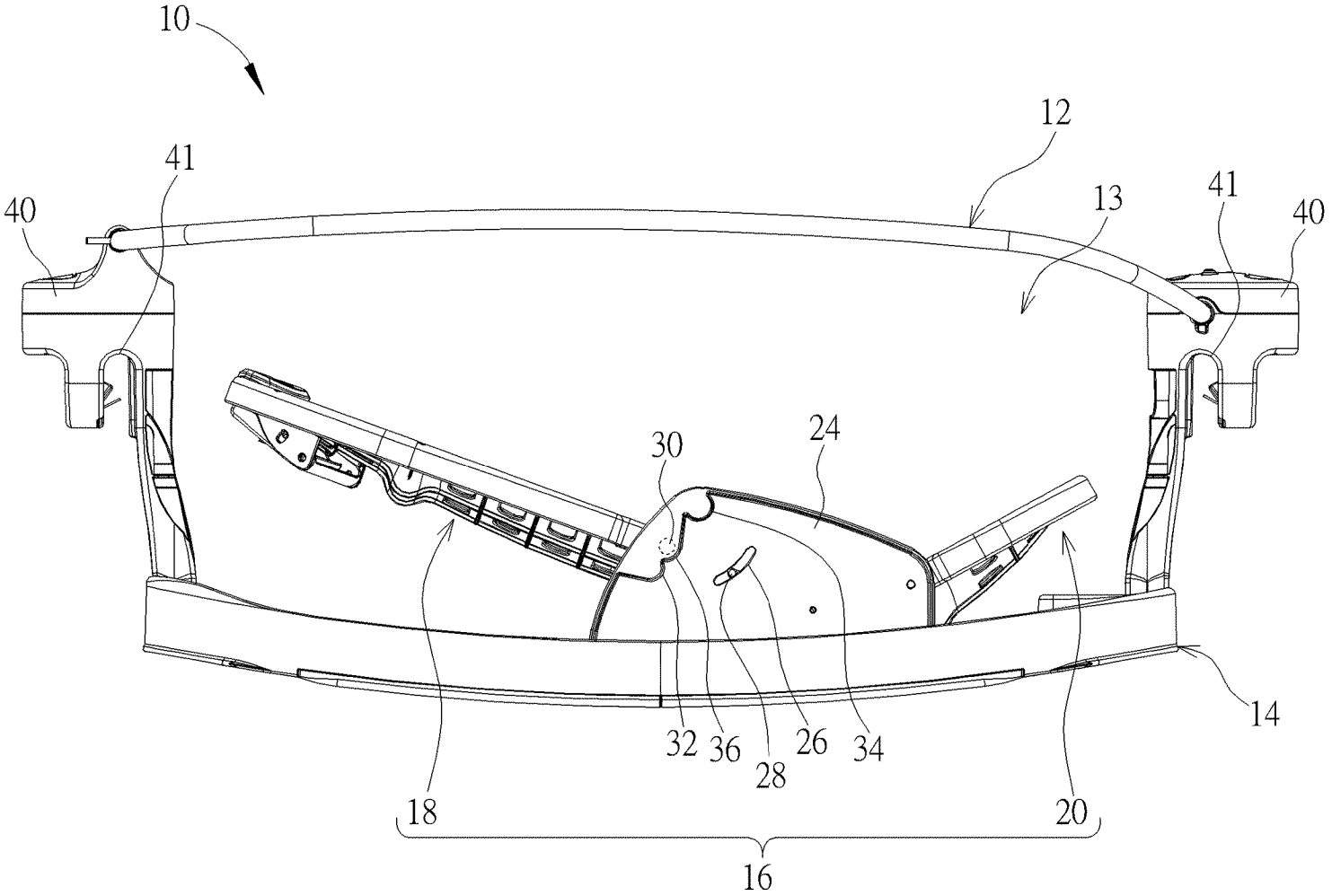
FIG. 4 is a side view of the seat back in FIG. 3 rotating to a recline position.

As for the positioning design of the seat back 18, it could be as shown in FIG. 2, FIG. 3, and FIG. 4. FIG. 4 is a side view of the seat back 18 in FIG. 3 rotates to a recline position. In this embodiment, the seat back 18 could further have a positioning pin 30, and the upright plate 24 could further have a first positioning groove 32 and a second positioning groove 34 corresponding to the positioning pin 30. Accordingly, when the seat back 18 rotates to the lying position as shown in FIG. 2, the positioning pin 30 is engaged with the first positioning groove 32 to fix the seat back 18 at the lying position. On the other hand, when the seat back 18 rotates to the sitting position as shown in FIG. 3, the positioning pin 30 is engaged with the second positioning groove 34 to fix the seat back 18 at the sitting position. Furthermore, in practical application, a third positioning groove 36 could preferably be formed between the first positioning groove 32 and the second positioning groove 34, so that the seat back 18 could be fixed at the recline position as shown in FIG. 4 located between the lying position and the sitting position when the positioning pin 30 is engaged with the third positioning groove 36. To be noted, in this embodiment, when the seat back 18 rotates between the recline position as shown in FIG. 4 and the sitting position as shown in FIG. 3, sliding of the guide pin 28 along the guide detail 26 and pivotal connection of the seat back 18 and the seat bottom 20 could cooperatively constrain the seat bottom 20 at a same tilted angle for seating comfort.

Figure 5:
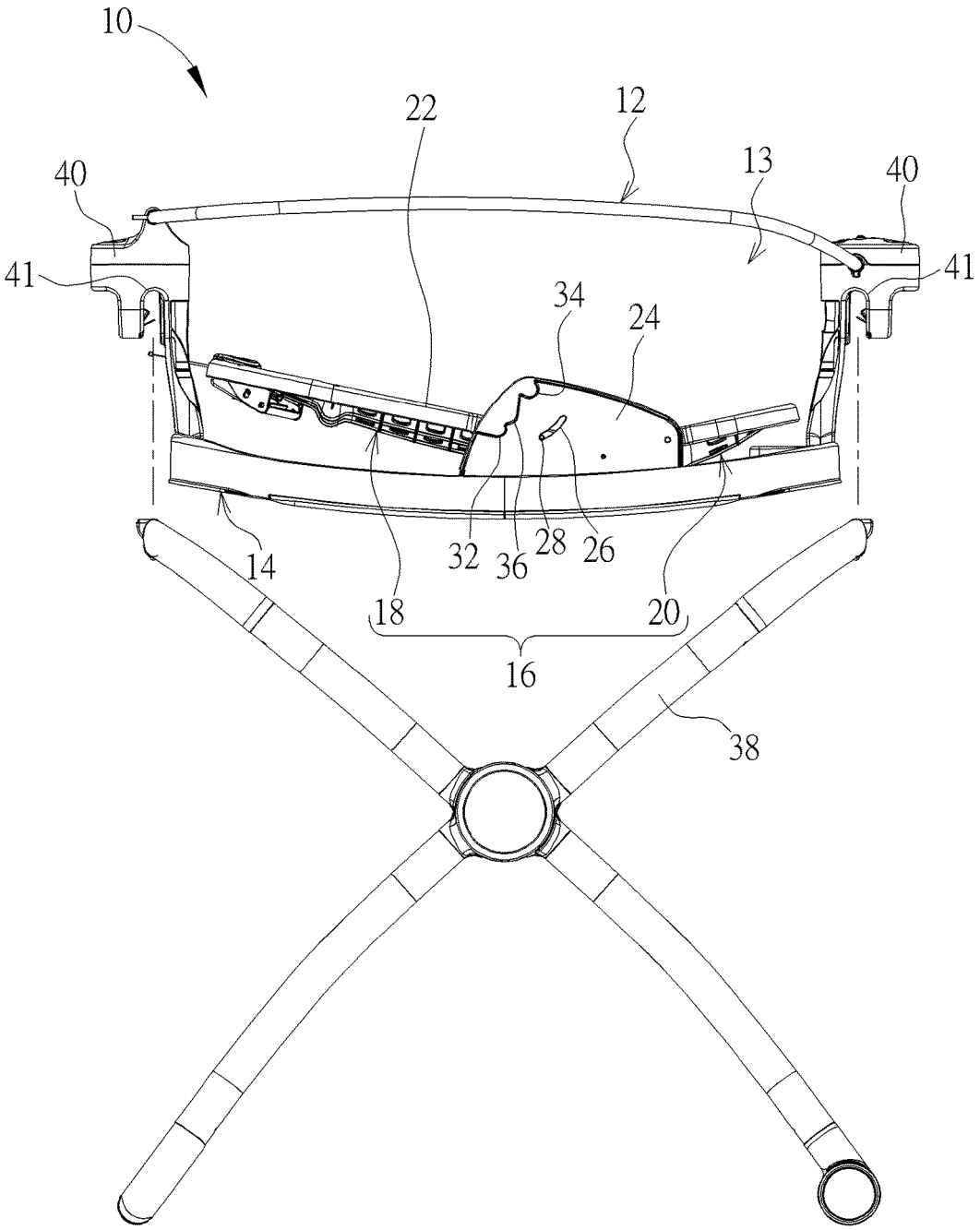
FIG. 5 is a side view showing that the infant support seat in FIG. 2 has not been mounted on a support frame.
Figure 6:
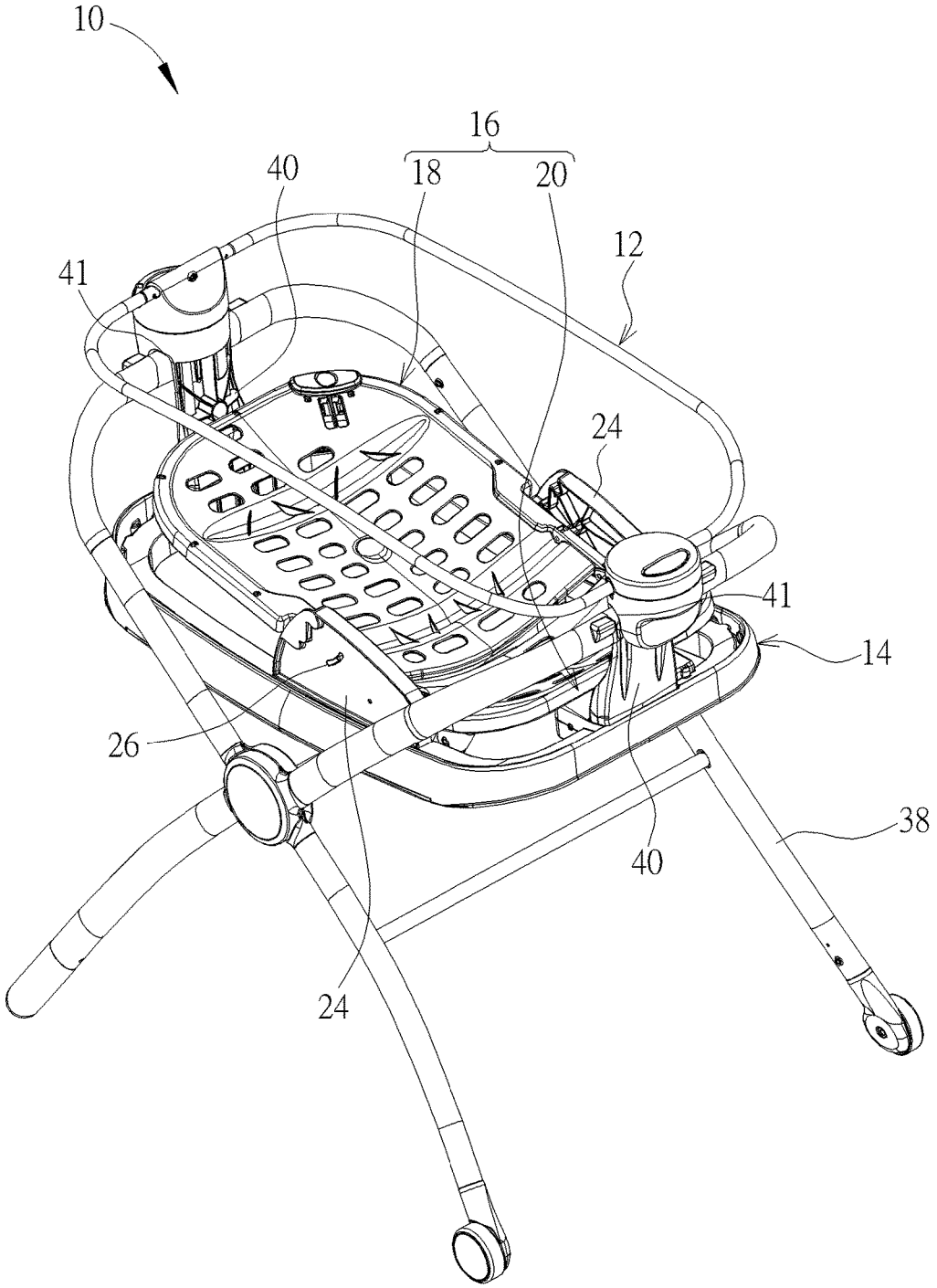
FIG. 6 is an assembly diagram of the infant support seat in FIG. 5 being assembled with the support frame.
Figure 7:
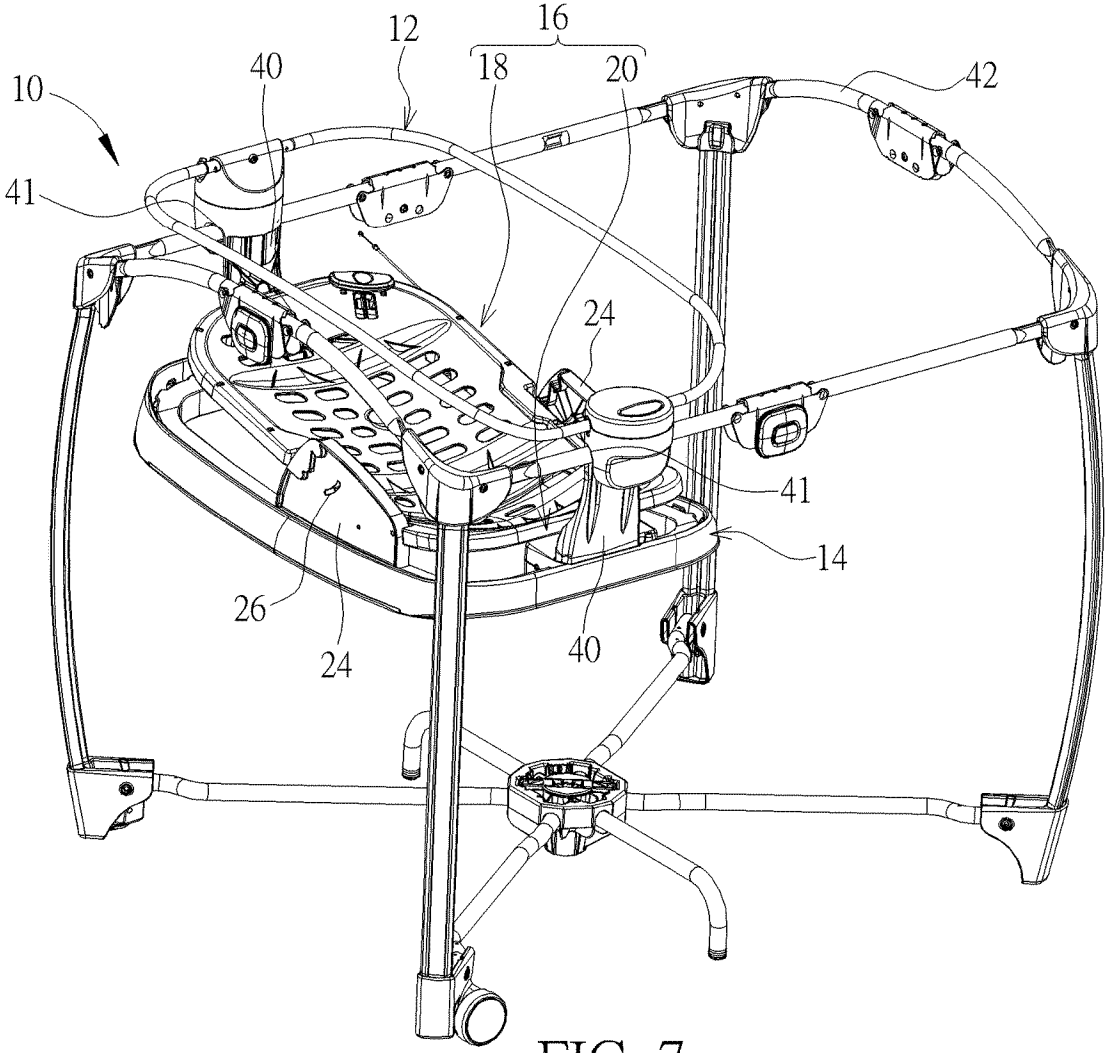
FIG. 7 is an assembly diagram of the infant support seat in FIG. 1 being assembled with a play yard.

Moreover, please refer to FIG. 5 and FIG. 6. FIG. 5 is a side view showing that the infant support seat 10 in FIG. 2 has not been mounted on a support frame 38. FIG. 6 is an assembly diagram of the infant support seat 10 in FIG. 5 being assembled with the support frame 38. As shown in FIG. 5 and FIG. 6, the lower frame structure 14 could further has two upright mounts 40, and the two upright mounts 40 could extend from two ends of the lower frame structure 14 respectively. The upper frame structure 12 is connected to the two upright mounts 40 respectively to be located above the lower frame structure 14 for defining the containing space 13 cooperatively with the lower frame structure 14 and the two upright mounts 40. In this embodiment, the support frame 38 could preferably be a foldable X-shaped frame to conveniently fold for transport or storage, and the frame geometry and wheel combination also allows the support frame 38 to stand when folded. Accordingly, the two upright mounts 40 could be mounted on the support frame 38 (e.g. by utilizing a hook 41 of each upright mount 40 to hang on the support frame 38, but not limited thereto) to make the seat structure 16 suspended on the support frame 38. In practical application, the mechanical design of the support frame on which the infant support seat 10 could be mounted is not limited to the aforesaid foldable X-shaped frame. That is to say, the infant support seat 10 could be mounted on any other type of support frame for baby care, such as a play yard 42 (briefly depicted in FIG. 7).

Via the aforesaid designs, the infant support seat 10 can serve multiple purposes. For example, when a caregiver wants an infant to lie flat on the seat structure 16, the caregiver just needs to rotate the seat back 18 to the lying position as shown in FIG. 2. During rotation of the seat back 18, the guide pin 28 could slide to the position as shown in FIG. 2 along the guide detail 26, so as to guide the positioning pin 30 to be engaged with the first positioning groove 32 for positioning the seat back 18 at the lying position and guide the seat bottom 20 to rotate downwardly together with the seat back 18 via pivotal connection between the seat back 18 and the seat bottom 20. Accordingly, the seat bottom 20 could form the lying surface 22 cooperatively with the seat back 18 when the seat back 18 rotates to the lying position as shown in FIG. 2. In such a manner, the caregiver can switch the infant support 10 to a sleep mode to help the infant lie flat on the lying surface 22, so as to make the infant feel more comfortable while the infant is sleeping.

On the other hand, when the caregiver wants the infant to sit on the seat structure 16 to do some activities, the caregiver just needs to rotate the seat back 18 to the sitting position as shown in FIG. 3. During rotation of the seat back 18, the guide pin 28 could slide to the position as shown in FIG. 3 along the guide detail 26, so as to guide the positioning pin 30 to be engaged with the second positioning groove 34 for positioning the seat back 18 at the sitting position and guide the seat bottom 20 to rotate to be tilted upward relative to the lower frame structure 14. Accordingly, the caregiver can switch the infant support 10 to an activity mode to help the infant sit on the seat structure 16 snugly.

Furthermore, if the caregiver just wants the infant to take a nap on the seat structure 16, the caregiver needs to rotate the seat back 18 to the recline position as shown in FIG. 4. During rotation of the seat back 18, the guide pin 28 could slide to the position as shown in FIG. 4 along the guide detail 26, so as to guide the positioning pin 30 to be engaged with the third positioning groove 36 for positioning the seat back 18 at the recline position (as mentioned above, at this time, the seat bottom 20 is constrained at the same tilted angle as shown in FIG. 3). Accordingly, the caregiver could switch the infant support 10 to a nap mode to help the infant recline on the seat structure 16, so as to make the infant feel more comfortable while the infant takes a nap.

In summary, compared with the infant support seat provided by the prior art only serving a singular purpose as a changer, a napper, or a bassinet, the present invention adopts the design that the seat back and the seat bottom are pivotally joined to each other to be rotatable at different oblique angles for making the infant support seat capable of serving multiple baby care purposes, so as to greatly enhance convenience of the infant support seat in use.

Figure 8:
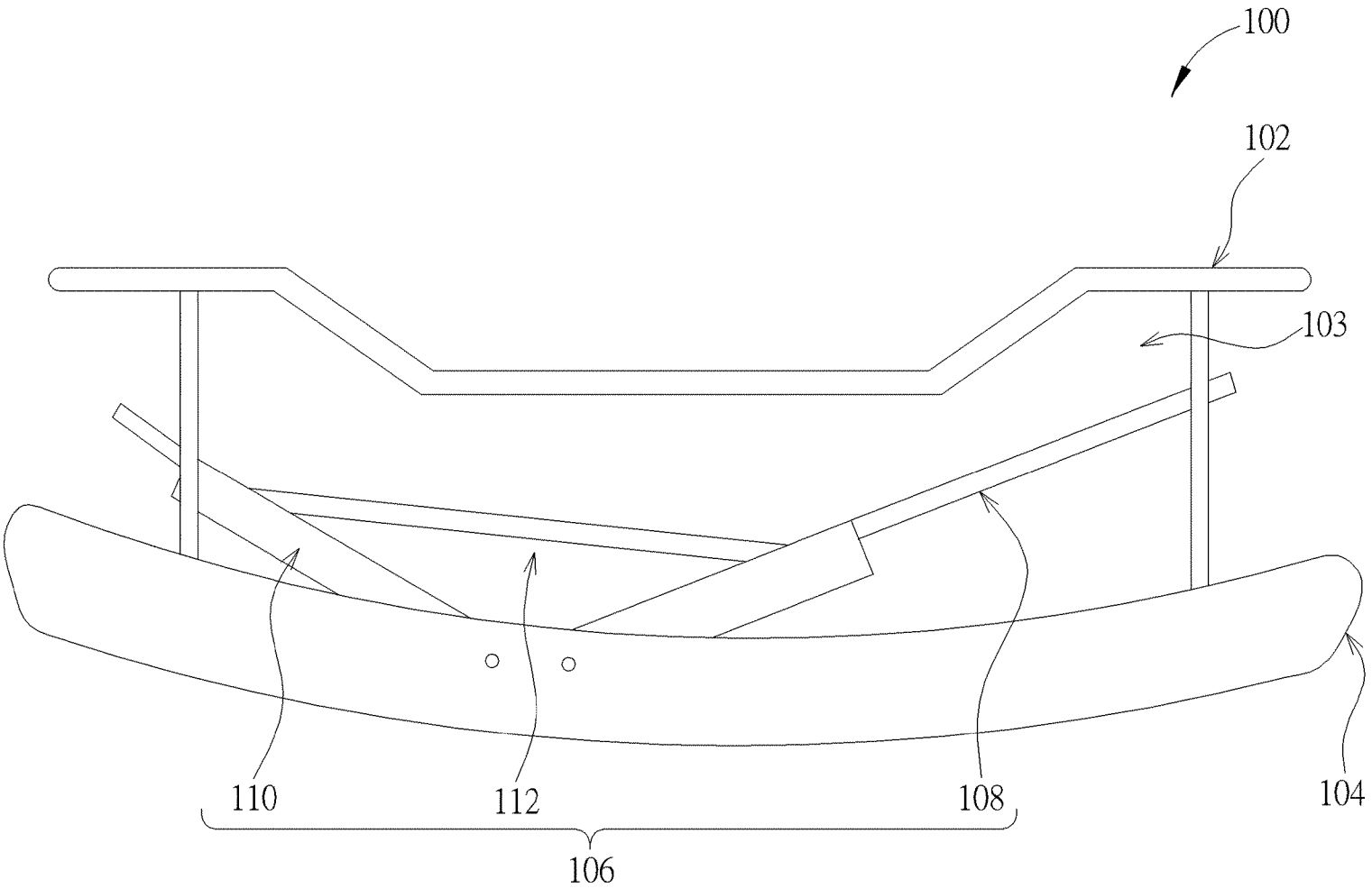
FIG. 8 is a side view of an infant support seat according to another embodiment of the present invention.
Figure 9:
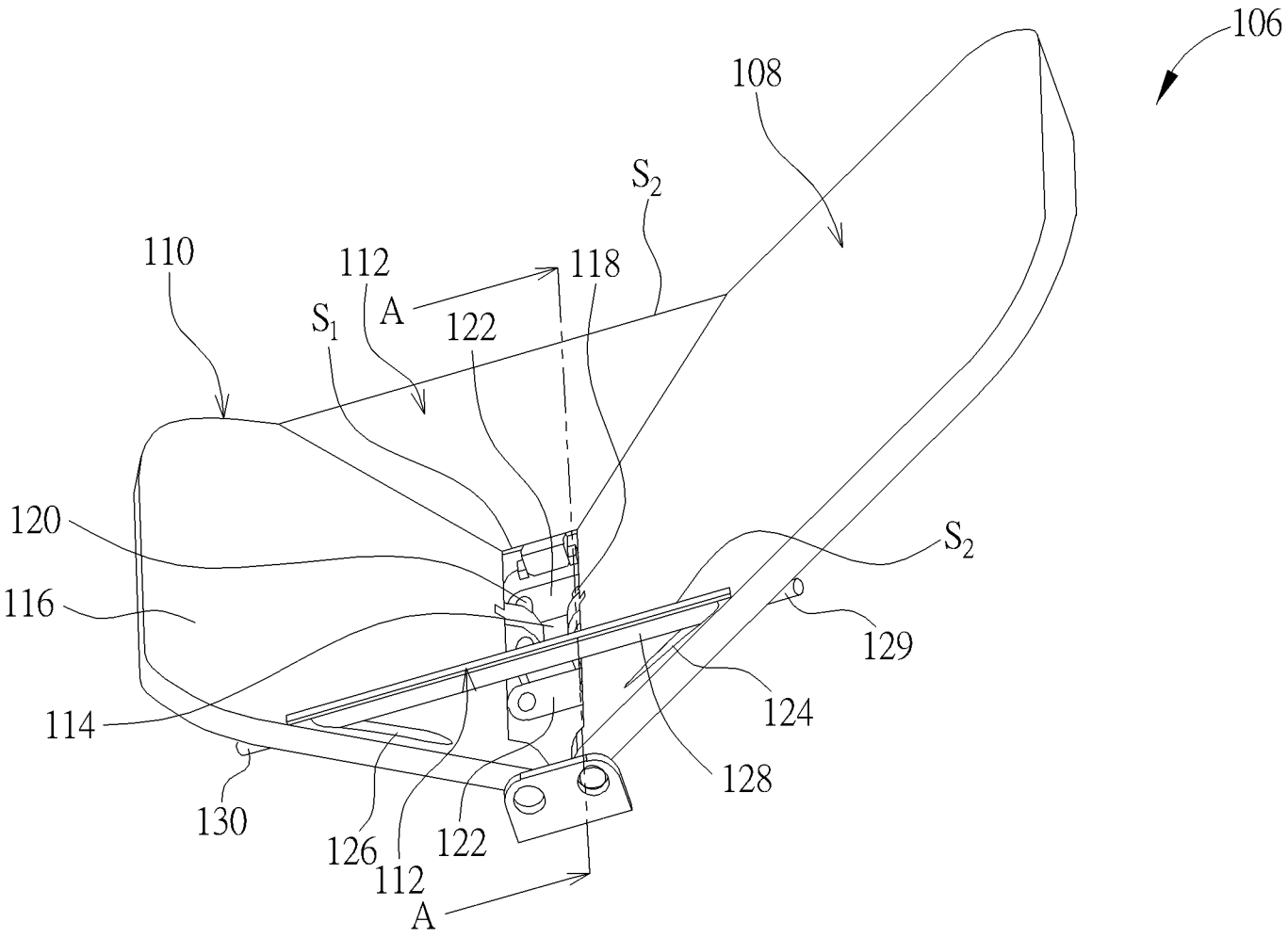
FIG. 9 is a diagram of a seat structure in FIG. 8.
Figure 10:
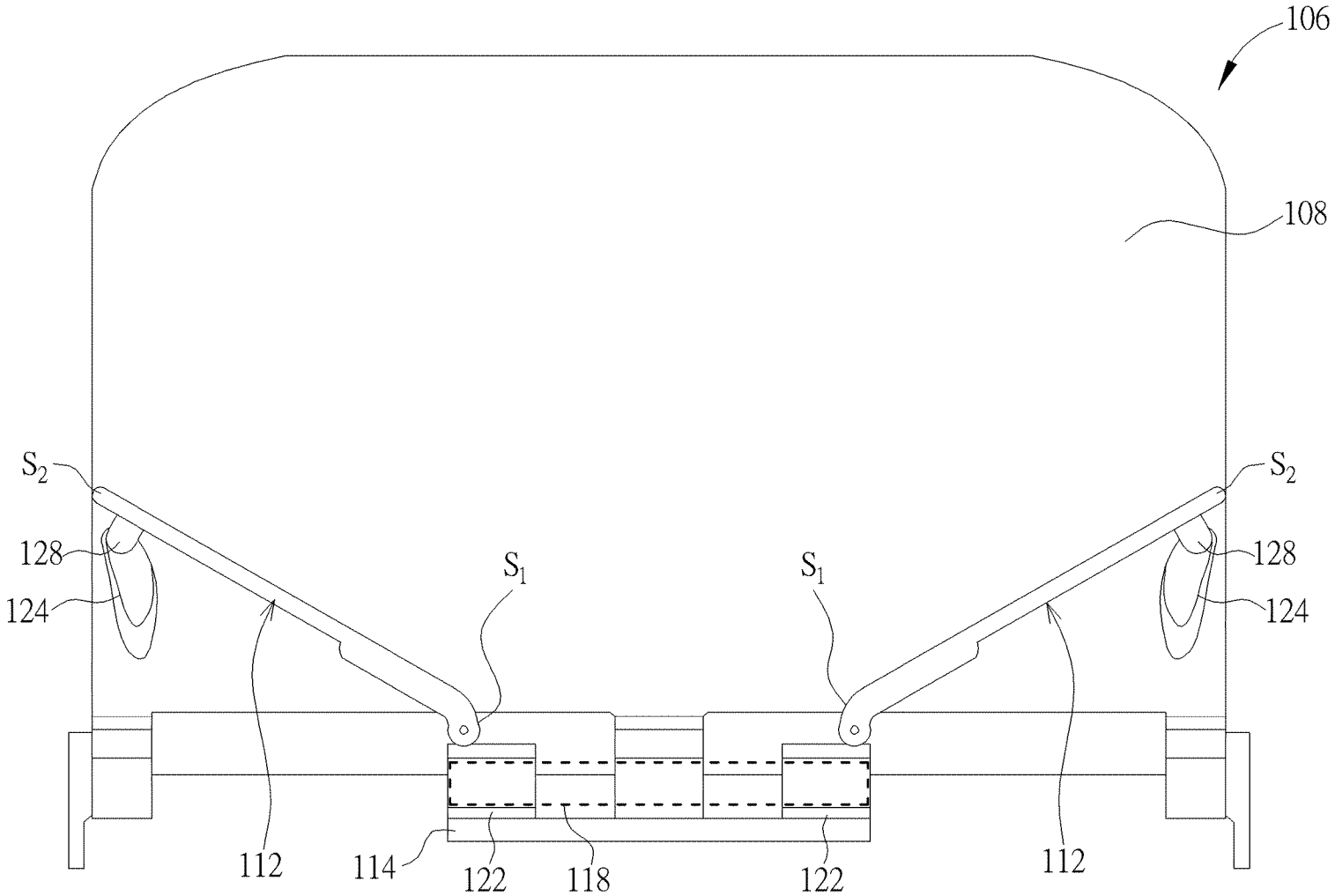
FIG. 10 is a cross-sectional diagram of the seat structure in FIG. 9 along a cross-sectional line A-A.

It should be mentioned that the mechanical design of the infant support seat is not limited to the aforesaid embodiment. For example, please refer to FIG. 8, FIG. 9, and FIG. 10. FIG. 8 is a side view of an infant support seat 100 according to another embodiment of the present invention. FIG. 9 is a diagram of a seat structure 106 in FIG. 8. FIG. 10 is a cross-sectional diagram of the seat structure 106 in FIG. 9 along a cross-sectional line A-A. As shown in FIG. 8, FIG. 9, and FIG. 10, the infant support seat 100 includes an upper frame structure 102, a lower frame structure 104, and the seat structure 106. The lower frame structure 104 is connected to the upper frame structure 102 to define a containing space 103 with the upper frame structure 102 and be located under the containing space 103. The seat structure 106 is disposed in the containing space 103 and includes a seat back 108, a seat bottom 110, and two side panels 112. The seat back 108 is pivoted to the lower frame structure 110 for rotating between a lying position and a sitting position. The seat bottom 110 has a bridge portion 114 and a bottom portion 116. The bridge portion 114 is pivoted to the bottom portion 116 and the seat back 108 respectively, and the bottom portion 116 is pivoted to the lower frame structure 104. The two side panels 112 are located at two sides of the bridge portion 114 respectively. A first side $S_1$ of each side panel 112 is slidably pivoted to the bridge portion 114. A second side $S_2$ of each side panel 112 is opposite to the first side $S_1$ and is slidably connected to the seat back 108 and the bottom portion 116. In this embodiment, each side panel 112 could preferably be in a trapezoid shape (but not limited thereto), meaning that the first side $S_1$ and the second side $S_2$ could be a top line and a base line of the trapezoid shape respectively.

To be more specific, the bridge portion 114 could have a first guide shaft 118, a second guide shaft 120, and two sliding bases 122 slidable along the first guide shaft 118 and the second guide shaft 120. The two sliding bases 122 are pivoted to the first sides $S_1$ of the two side panels 112 respectively. Furthermore, in this embodiment, the seat back 108 could have two first guide tracks 124 formed on two sides of the seat back 108, and the bottom portion 116 could have two second guide tracks 126 formed corresponding to the first guide tracks 124. A guide pin 128 could be formed along the second side of each side panel 112 and have a first end portion 129 slidably disposed in the corresponding first guide track 124 and a second end portion 130 slidably disposed in the corresponding second guide track 126.

Figure 11:
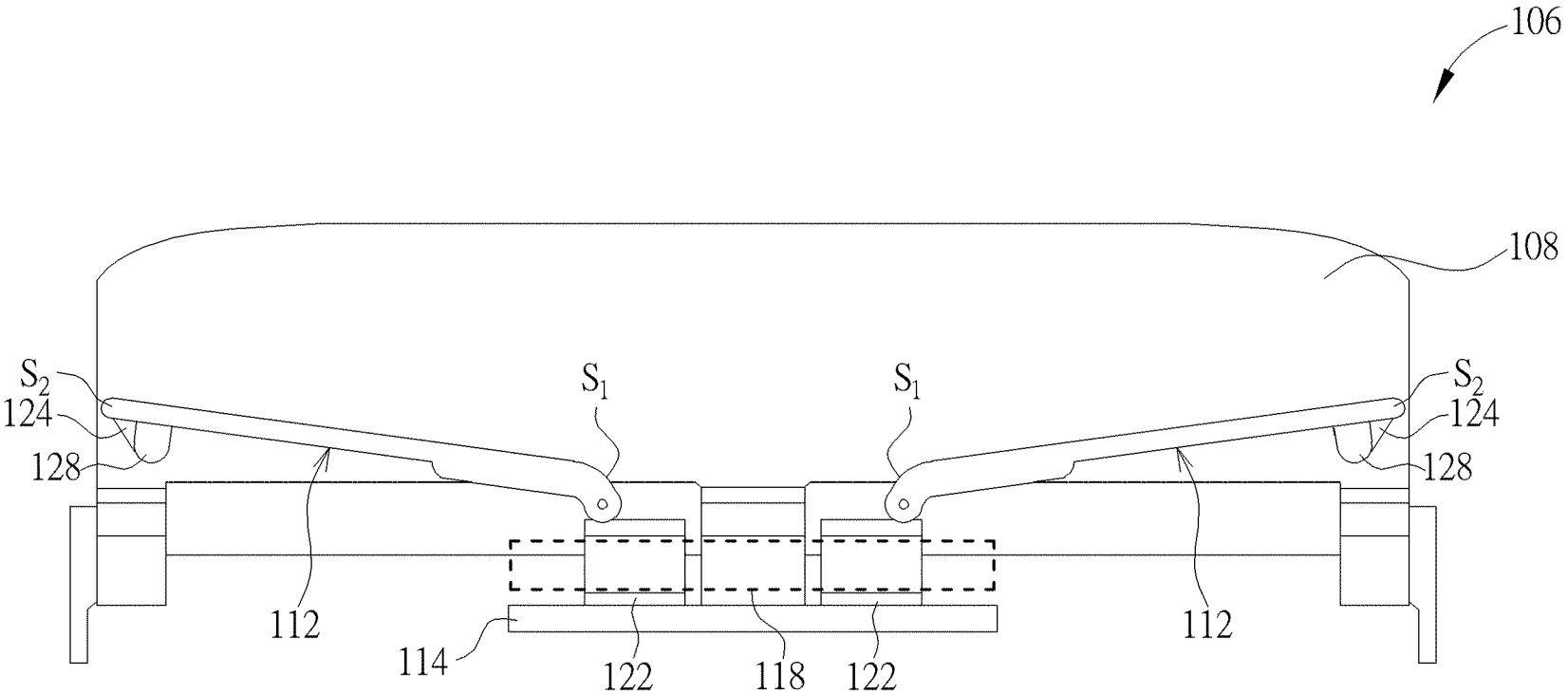
FIG. 11 is a cross-sectional diagram of the seat back in FIG. 10 rotating to the lying position.
Figure 12:
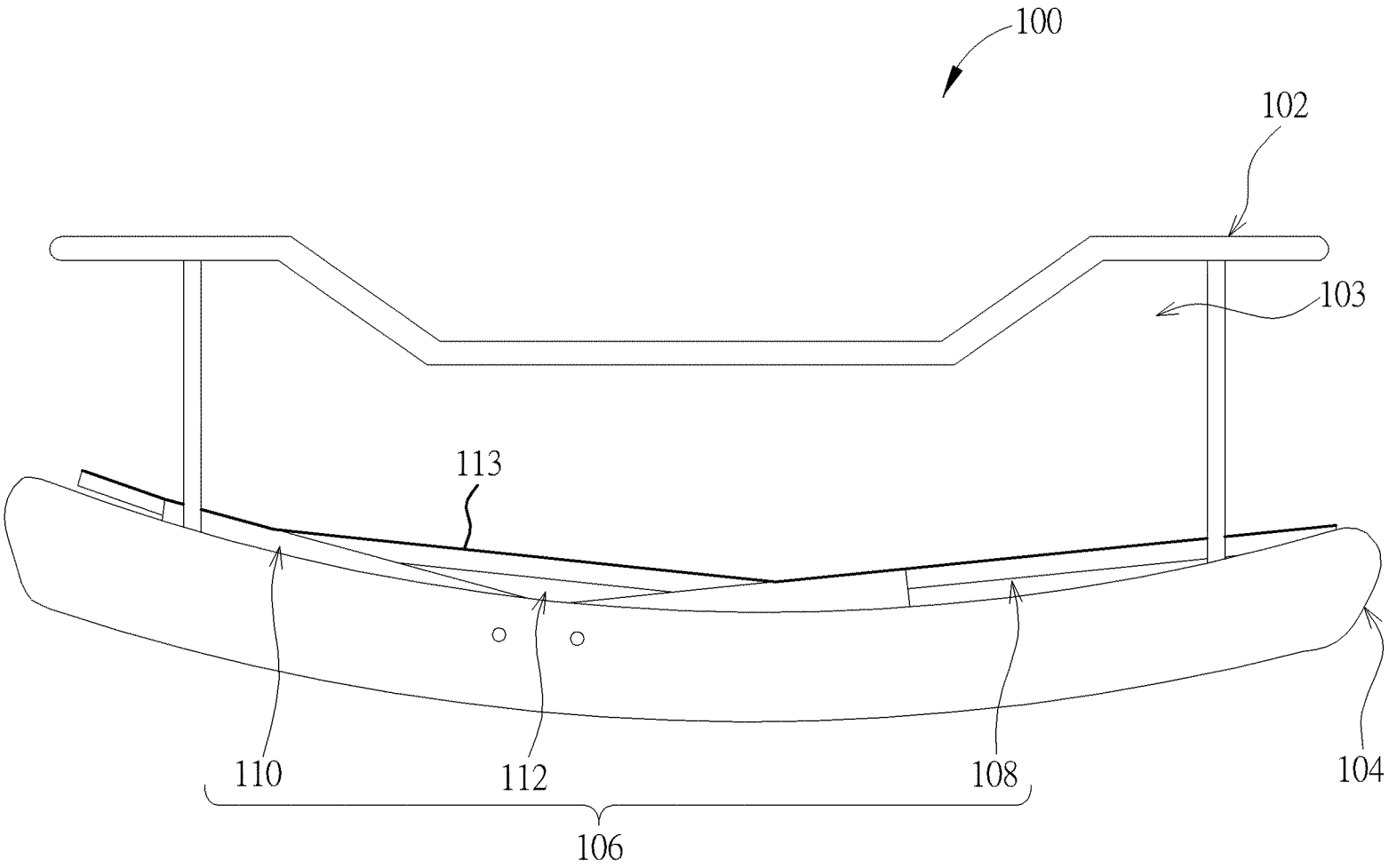
FIG. 12 is a side view of the seat back in FIG. 8 rotating to the lying position.

More detailed description for the rotating operation of the infant support seat 100 is provided as follows. Please refer to FIG. 8, FIG. 9, FIG. 10, FIG. 11, and FIG. 12. FIG. 11 is a cross-sectional diagram of the seat back 108 in FIG. 10 rotating to the lying position. FIG. 12 is a side view of the seat back 108 in FIG. 8 rotating to the lying position. When a caregiver wants the infant to sit on the seat structure 106 to do some activities, the caregiver just needs to rotate the seat back 108 to the sitting position as shown in FIG. 8. During rotation of the seat back 108, as shown in FIG. 9 and FIG. 10, the first side $S_1$ of each side panel 112 slides outwardly along the first guide shaft 118 (briefly depicted by dotted lines in FIG. 10) and the second guide shaft 120 of the bridge portion 114 via the corresponding sliding base 122, and the first end portion 129 of the guide pin 128 on the second side $S_2$ of each side panel 112 slides along the corresponding first guide track 124 as the second end portion 130 of the guide pin 128 on the second side $S_2$ of each side panel 122 slides along the corresponding second guide track 126, so as to make each side panel 112 pivots upwardly and inwardly relative to the bridge portion 114. Accordingly, the bottom portion 116 can rotate together with the seat back 108 to be tilted upward relative to the lower frame structure 104 as shown in FIG. 8. In such a manner, with rotation of the seat back 108 to the sitting position as shown in FIG. 8, FIG. 9, and FIG. 10, the two side panels 112 can pivot upwardly and inwardly and the bottom portion 116 can rotate to be tilted upward relative to the lower frame structure 104, so that the seat structure 106 could cradle the infant's hips and give a more snug seated position.

On the other hand, when the caregiver wants the infant to lie flat on the seat structure 106, the caregiver just needs to rotate the seat back 108 from the sitting position as shown in FIG. 8 to the lying position as shown in FIG. 12. During rotation of the seat back 108, as shown in FIG. 10 and FIG. 11, the first side $S_1$ of each side panel 112 slides inwardly from the position as shown in FIG. 10 to the position as shown in FIG. 11 along the first guide shaft 118 and the second guide shaft 120 of the bridge portion 114 via the corresponding sliding base 122, and the first end portion 129 of the guide pin 128 on the second side $S_2$ of each side panel 112 slides along the corresponding first guide track 124 as the second end portion 130 of the guide pin 128 on the second side $S_2$ of each side panel 122 slides along the corresponding second guide track 126. Accordingly, with rotation of the seat back 108 to the lying position as shown in FIG. 12, the two side panels 112 can open up to form a lying surface 113 (depicted by bold lines in FIG. 12) cooperatively with the seat bottom 110 and the seat back 108, so as to give the infant a roomier and more comfortable sleeping environment. To be noted, the design that the infant support seat could be mounted on a support frame mentioned in the aforesaid embodiment could be applied to the infant support seat 100, and the related description could be reasoned by analogy according to the aforesaid embodiment and therefore omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant support seat comprising:

an upper frame structure;

a lower frame structure connected to the upper frame structure to define a containing space with the upper frame structure and be located under the containing space; and a seat structure disposed in the containing space, the lower frame structure having two upright mounts, the two upright mounts extending from two ends of the lower frame structure respectively for mounting on a support frame to make the seat structure suspended on the support frame, the seat structure comprising:

a seat back rotatable relative to the lower frame structure for rotating between a lying position and a sitting position; and a seat bottom pivotally joined to the seat back, the seat bottom being rotatable relative to the lower frame structure to form a lying surface cooperatively with the seat back when the seat back rotates to the lying position and rotate to be tilted upward relative to the lower frame structure when the seat back rotates to the sitting position.

2. The infant support seat of claim 1, wherein the upper frame structure is connected to the two upright mounts respectively to be located above the lower frame structure for defining the containing space cooperatively with the lower frame structure and the two upright mounts.

3. The infant support seat of claim 1, wherein at least one side of the lower frame structure has an upright plate extending therefrom, a guide detail is formed on the upright plate, the seat back has a guide pin slidably disposed through the guide detail, the seat bottom is pivotally connected to the upright plate, a pivotal position of the seat back and the seat bottom is located between the guide pin and a pivotal position of the seat bottom and the upright plate, and during rotation of the seat back, the guide pin slides along the guide detail to guide the seat back to rotate between the lying position and the sitting position and the seat bottom rotates together with the seat back via pivotal connection between the seat back and the seat bottom.

4. The infant support seat of claim 3, wherein the seat back further has a positioning pin, and the upright plate further has a first positioning groove and a second positioning groove corresponding to the positioning pin; when the seat back rotates to the lying position, the positioning pin is engaged with the first positioning groove to fix the seat back at the lying position; when the seat back rotates to the sitting position, the positioning pin is engaged with the second positioning groove to fix the seat back at the sitting position.

5. The infant support seat of claim 4, wherein a third positioning groove is formed between the first positioning groove and the second positioning groove; when the positioning pin is engaged with the third positioning groove, the seat back is fixed at a recline position located between the lying position and the sitting position.

6. The infant support seat of claim 5, wherein when the seat back rotates from the recline position to the sitting position, sliding of the guide pin along the guide detail and pivotal connection of the seat back and the seat bottom constrain the seat bottom at a same tilted angle.

7. An infant support seat comprising:

an upper frame structure;

a lower frame structure connected to the upper frame structure to define a containing space with the upper frame structure and be located under the containing space; and a seat structure disposed in the containing space, the seat structure comprising:

a seat back pivoted to the lower frame structure for rotating between a lying position and a sitting position;

a seat bottom having a bridge portion and a bottom portion, the bridge portion being pivoted to the bottom portion and the seat back respectively, the bottom portion being pivoted to the lower frame structure; and two side panels located at two sides of the bridge portion respectively, a first side of each side panel being slidably pivoted to the bridge portion, a second side of each side panel being slidably connected to the seat back and the bottom portion, the first side being opposite to the second side;

wherein when the seat back rotates from the lying position to the sitting position, the first side of each side panel slides along the bridge portion and the second side of each side panel slides on the seat back and the bottom portion respectively with rotation of the seat back to make each side panel pivots upwardly and inwardly relative to the bridge portion, so as to guide the bottom portion to rotate together with the seat back to be tilted upward relative to the lower frame structure.

8. The infant support seat of claim 7, wherein the bridge portion has a first guide shaft, a second guide shaft, and two sliding bases slidable along the first guide shaft and the second guide shaft, the two sliding bases are pivoted to the first sides of the two side panels respectively;

wherein when the seat back rotates from the lying position to the sitting position, the first side of each side panel slides outwardly along the first guide shaft and the second guide shaft of the bridge portion via the corresponding sliding base.

9. The infant support seat of claim 7, wherein the seat back has two first guide tracks formed on two sides of the seat back, the bottom portion has two second guide tracks formed corresponding to the first guide tracks, a guide pin being formed along the second side of the side panel and having a first end portion slidably disposed in the corresponding first guide track and a second end portion slidably disposed in the corresponding second guide track;

wherein when the seat back rotates from the lying position to the sitting position, the first end portion of the guide pin of each side panel slides along the corresponding first guide track and the second end portion of the guide pin of each side panel slides along the corresponding second guide track to make each side panel pivots upwardly and inwardly relative to the bridge portion.

10. The infant support seat of claim 7, wherein each side panel is in a trapezoid shape having a top line corresponding to the first side and a base line corresponding to the second side.

* * * * *